US005209084A

United States Patent [19]

Robinson et al.

[11] Patent Number: 5,209,084

[45] Date of Patent: May 11, 1993

[54] KNITTED FABRIC HAVING LOW STRETCH FOR UPHOLSTERY

[75] Inventors: Frank Robinson; Gerald F. Day, both of Breaston, United Kingdom

[73] Assignee: General Motors Corporation, Detroit, Mich.

[21] Appl. No.: 675,167

[22] Filed: Mar. 26, 1991

[30] Foreign Application Priority Data

Mar. 27, 1990 [GB] United Kingdom ..... 9006773

[51] Int. Cl.[5] ..... D04B 1/00

[52] U.S. Cl. ..... 66/196; 66/202

[58] Field of Search ..... 66/196, 202; 428/36.1

[56] References Cited

U.S. PATENT DOCUMENTS 4,833,028 5/1989 Melez ..... 428/36.1
5,027,618 7/1991 Robinson et al. ..... 66/202
5,073,441 12/1991 Melez et al. ..... 66/202 X

FOREIGN PATENT DOCUMENTS 1166473 10/1969 United Kingdom .
1482416 8/1977 United Kingdom .
1552231 9/1979 United Kingdom .
1558425 1/1980 United Kingdom .
2206609 1/1989 United Kingdom .
2223035 3/1990 United Kingdom ..... 66/196

*Primary Examiner*—Werner H. Schroeder
*Assistant Examiner*—John J. Calvert
*Attorney, Agent, or Firm*—Davis Hoxie Faithful & Hapgood

[57] ABSTRACT

A weft knitted double-jersey fabric is knitted in a construction of repeating groups of courses in which some courses have loops pulled to both fabric faces and some courses have loops pulled to one fabric face and are transversed by yarn regions which extend across at least two wales and up to seven or more wales. The yarn feed to the needle beds of the knitting machine is limited to no more than 4.0 cm/cm of bed length over which the fabric is knitted in courses in which loops are pulled to both faces of the fabric and to no more than 2.0 cm/cm of bed length, preferable no more than 1.8 cm/cm, in courses in which loops are pulled to one face of the fabric. The fabric has an extensibility of no more than 12% in wale and course directions. It is knitted with a high count yarn of 550 to 850 decitex which may be an air-textured polyester yarn. It is suitable for use as upholstery fabric particularly in the form of a vehicle seat upholstery cover which may be shaped to fit the seat in the knitting process.

24 Claims, 2 Drawing Sheets

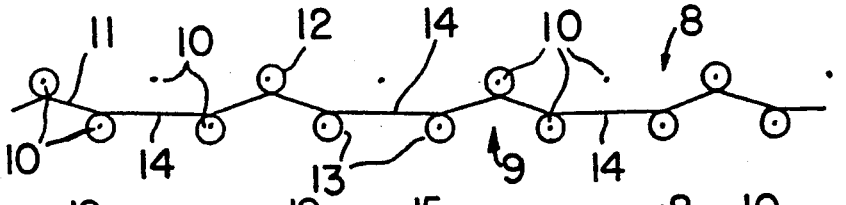
FIG.1a
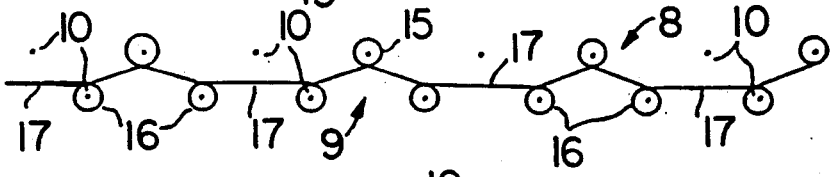
FIG.1b
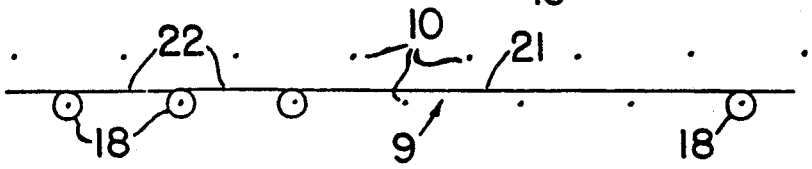
FIG.1c
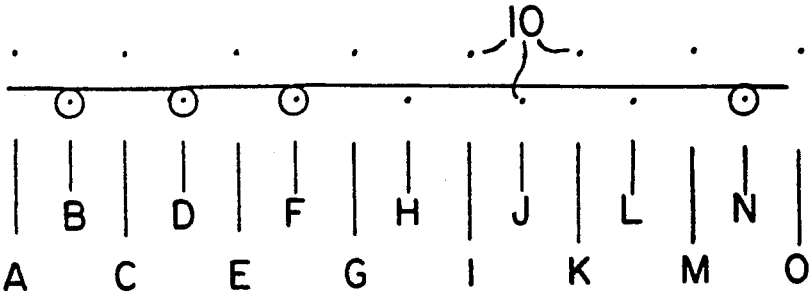
FIG.1d
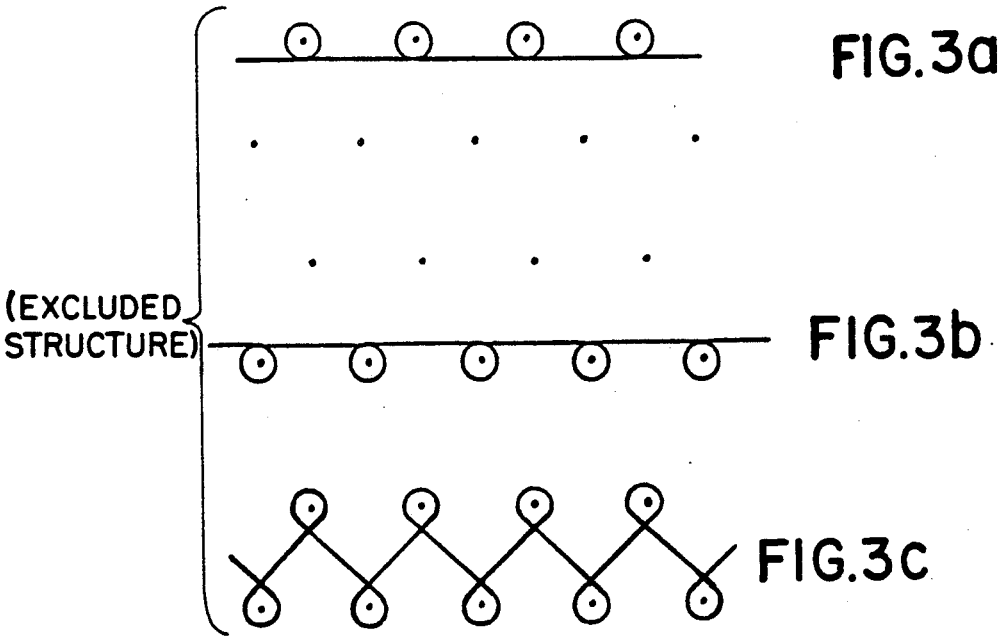
FIG.3a
FIG.3b
FIG.3c

KNITTED FABRIC HAVING LOW STRETCH FOR UPHOLSTERY

FIELD OF THE INVENTION

This invention relates to a knitted fabric suitable for use as an upholstery fabric, for example for covering seats of vehicles such as automobiles, aircraft and trains. The term "seats" is used generally to include seat backs.

BACKGROUND OF THE INVENTION

Hitherto, woven fabrics have been used for covering vehicle seats and some warp knitted fabrics have been used for the same purpose. Weft knitted fabric has potential advantages for use in vehicle upholstery in terms of the ability of weft knitting machines to shape the fabric so that the number of seams required in a seat cover can be reduced. However, the inherent stretchability of conventional weft knitted fabric has been a major factor in preventing its use in vehicle upholstery because it gives rise to unsightly distortion and to damage of the fabric in use.

The present invention is based on the discovery that the choice of the right stitch structure together with a sufficient degree of tightness in that structure, that is a sufficiently small loop size, permit weft knitted fabrics to be produced which are sufficiently rigid and resistant to deformation as to make them suitable for upholstery use and some such fabrics can be made which are able to fulfill the stringent requirements for potential use in upholstery covers for automobile seats. The rigidity required for such upholstery fabric has been assessed as an extensibility in the course and wale directions of 12% or less in each case, when measured by the standard test procedure on a Fryma extensiometer.

SUMMARY OF THE INVENTION

According to this invention, a weft knitted double jersey fabric suitable for use as an upholstery fabric has at least a substantial part of the fabric of a repeating structure of a group of at least three courses which includes a course or courses having loops pulled to both faces of the fabric, a course or courses having all, or substantially all, loops pulled to one face of the fabric, and yarn regions extending course-wise without loops, the wales transverse to said group of courses comprising repeating sets of wales in which a first set of two or more wales is adjacent to a second set of two or more wales, adjacent wales in the first set having loops on opposite faces of the fabric with the loops on one face being in number ratio to the loops on the other face of at least 3:1, preferably at least 4:1, and the second set of wales being traversed in at least one of the courses in which all, or substantially all, of the loops are pulled to one face of the fabric by a yarn region without loops which extends between loops across two or more wales, said structure and the tightness of the knitting being such that the stretch of the fabric is no more than 12% in wale and course directions respectively. In one or both wale and course directions, the extensibility may be no more than 10% and even no more than 8%.

Preferably, a group of courses comprises at least four courses and these preferably include at least two courses which have a yarn region without loops which extends between loops across two or more wales in said second set of wales. In a group of courses, the number of courses having loops pulled to both faces of the fabric may be equal to the number of courses having all, or substantially all, loops pulled to one face of the fabric.

The group of courses has been referred to as repeating which means that each repeat has the structure referred to but does not necessarily imply identity between repeats. For example, in two successive groups of courses, a first set of wales in the first group of courses may be aligned with a second set of wales in the second group of courses and a second set of wales in the first group of courses may be aligned with a first set of wales in the second group of courses. A structure of this type is illustrated in FIG. 2 of the drawings.

The yarn region referred to as extending between loops over at least two wales in the second set of wales, preferably extends over at least three wales, more preferably over at least four wales, and may even extend over seven wales or more.

It is also preferred that for all, or substantially all, of those courses in which all, or substantially all, of the loops are pulled to one face of the fabric and which incorporate the aforesaid yarn regions extending between loops across at least two wales, it is the same face of the fabric to which said loops are pulled. This emphasises the imbalance between the numbers of knitted loops on the respective faces of the fabric, which can improve rigidity. In addition, patterning of the face of the fabric which will be exposed in use is facilitated by this arrangement which can also give a fabric face having improved resistance to wear and tear because of a greater concentration of smaller knitted loops on that surface.

As well as yarn regions as referred to in the previous paragraph, (that is located in at least one course in which all or substantially all of the loops are pulled to one face of the fabric) there may be additional yarn regions extending course-wise without loops across at least one wale in one or more other courses. These include courses of both types referred to, that is courses with loops pulled to both faces of the fabric and courses with all, or substantially all, loops pulled to one face of the fabric. Preferably all, or substantially all, of the additional yarn regions extend between loops which are pulled to the same face of the fabric as the loops in the courses which incorporate the yarn regions extending between loops across at least two wales. In the case of courses in which the loops are pulled to both faces of the fabric, there may be two or more such courses, in which case it is preferred that said additional yarn regions in one such course extend across wales which are different from the wales across which said additional yarn regions extend in another such course. An arrangement of this sort is shown in FIG. 1, courses (a) and (b) of the accompanying drawings.

The off-setting as between wales of the relatively inextensible yarn regions which extend along different courses helps to counter-balance the inherent extensibility provided by sections of courses in which loops are pulled to both faces of the fabric and to promote rigidity throughout the fabric. The incidence of these yarn regions combined with the general structure described and the tightness of the knitting allows the achievement of the desired limit on extensibility of no more than 12% in both course and wale directions.

The required tightness of knitting may be achieved by limiting the yarn supplied to form the courses of knitting. This may be expressed in terms of yarn length supplied per length of needle bed over which the fabric is knitted for each course.

Expressed in this way, low extensibility is promoted if at least in some courses having loops pulled to both faces of the fabric, the length of yarn supplied per length of needle bed over which the fabric is knitted is no more than 4.0 cm/cm and in at least some courses having all, or substantially all, loops pulled to one face of the fabric, the length of yarn supplied per length of needle bed over which the fabric is knitted is no more than 2.0 cm/cm, preferably no more than 1.8 cm/cm.

The yarn supplied to the needles may also be characterised in terms of the length of yarn supplied to a course per the number of active needles used in knitting that course. This is called the yarn length per active needles. Expressed in this way, it is preferred that the yarn length per active needles in a course is less than 0.40 cm in at least some courses having loops pulled to both faces of the fabric and is less than 0.20 cm in at least some courses in which all, or substantially all, loops are pulled to one face of the fabric.

It is also possible to characterise the length of yarn supplied to a course in terms of the total number of needles which are at some time active in knitting the fabric. This is called the yarn length per total needles.

The yarn used for knitting the weft knitted fabric of the invention is preferably a textured continuous filament synthetic yarn. It preferably has a count in the unrelaxed state in the range 550 to 850 decitex, more preferably in the range 680 to 750 decitex. A particularly preferred yarn is an air-textured continuous filament polyester yarn.

The machine used to knit the weft knitted fabric of the invention is preferably a flat V-bed knitting machine of gauge in the range 10 to 14. Gauge is an expression of the number of needles per inch along the bed of the knitting machine so that 10 to 14 gauge machines have needle bed densities in the range 3.94 to 5.51 needles per cm. A preferred machine is a 12 gauge machine. Cylinder and dial circular machines may also be used.

The invention includes an upholstery cover for a vehicle seat, particularly an automotive vehicle seat, which comprises weft knitted fabric according to the invention. Preferably such weft knitted fabric has been shaped in the knitting to produce a cover which is thereby shaped at least in part in fit the vehicle seat.

The invention includes a process for weft knitting a double jersey fabric suitable for use as an upholstery fabrics. Yarns are fed to beds of needles on a weft knitting machine and knitting using the needles to form a weft knitted fabric. At least a substantial part of the fabric is knitted with a repeating structure of a group of at least three courses which includes a course or courses having loops pulled to both faces of the fabric, a course or courses having all, or substantially all, loops pulled to one face of the fabric, and yarn regions extending course-wise without loops. The wales transverse to the group of courses have repeating sets of wales in which a first set of two or more wales is adjacent to a second set of two or more wales. Adjacent wales in the first set have loops on opposite faces of the fabrics, the loops on one face being in number ratio to the loops on the other face of at least 3:1, preferably at least 4:1. The second set of wales is traversed in at least one of the courses in which all, or substantially all, of the loops are pulled to one face of the fabric by a yarn region without loops which extends between loops across two or more wales. The yarn feed to the needle beds is limited such that in at least some courses having loops pulled to both faces of the fabric, the length of yarn supplied per length of the needle bed, over which the fabric is knitted, is no more than 4.0 cm/cm. In at least some courses in which all, or substantially all, of the loops are pulled to one face of the fabric, the length of yarn supplied per length of needle bed over which the fabric is knitted is no more than 2.0 cm/cm and preferably no more than 1.8 cm/cm.

BRIEF DESCRIPTION OF DRAWINGS

The invention will be further described, by way of example, with reference to the accompanying drawings in which:

FIGS 1*a*–1*d* diagrammatically four successive courses (a) to (d) in a fabric according to the invention having a striped pattern and knitted on needles of opposed needle beds of a flat V-bed knitting machine, the letters A to O representing wales, wales A to L representing one sequence.

FIGS. 3*a* , 3*b* , and 3*c* are representations similar to those of FIGS. 1 and 2 but showing three successive courses (a) to (c) of a Milano rib fabric which, in the form described below, does not fulfil the requirements of the invention.

DESCRIPTION OF PREFERRED EMBODIMENTS

Figure 2A:
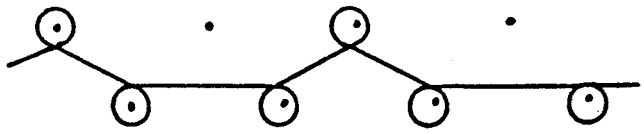
FIGS. 2(*a*) to 2(*h*) are representations similar to that of FIG. 1 but showing eight successive courses (a) to (h), of an alternating structure in a striped fabric according to the invention.

FIG. 1 of the drawings illustrates diagrammatically knitting of four successive courses in a striped fabric according to the invention. The points 10 represent needles of the two opposed needle beds of a flat V-bed knitting machine.

FIG. 1 courses (a) to (d) are designated courses 1(*a*) to 1(*d*) respectively.

In course 1(*a*), yarn 11 is supplied to needles of both needle beds of the knitting machine so that in this course loops 12 are pulled to one face 8 of the fabric produced and loops 13 are pulled to the other face 9 of the fabric. The pattern of loops in the course 1(*a*) is 1×2, that is single loops 12 pulled to the face 8 of the fabric are interspersed in each case with two loops 13 pulled to the face 9 of the fabric, thus forming yarn regions 14, which contain no knitted loops, and extend in the direction of the course 1(*a*) between adjacent loops 13 pulled to the face 9 of the fabric. The regular 1×2 loop configuration of this rib (i.e. double-jersey) course 1(*a*) ensures that the yarn regions 14 occur at regular wale locations along the course.

Course 1(*b*) of the fabric of FIG. 1 also has a 1×2 stitch configuration formed on the needles 10, loops 15 being pulled to face 8 and loops 16 to face 9 of the fabric. Adjacent loops 16 have yarn regions 17, without knitted loops, extending course-wise between them but the loop configuration in course 1(*b*) is such that the wale location of the yarn regions 17 is different from the location of the yarn regions 14. The wales in the fabric are indicated by letters A, B, C, etc. at the bottom of FIG. 1 and the yarn regions 14 in course 1(*a*) occur in wales C, G and K whereas the yarn regions 17 in course 1(*b*) occur in wales A,E,I and M. Thus, the regions of the fabric represented, for example, by wale groups D, E and F or H, I and J which, according to the structure of course 1(*a*), would be expected to be relatively extensible in the course-wise direction are rendered more rigid (that is less extensible) because of the presence of the course-wise extending yarn regions 17 without knitted loops in the adjacent course 1(*b*).

The yarn regions 14 of course 1(*a*) provide rigidity in the wale regions B, C, D and F, G, H, etc.

Course 1(*c*) of the fabric, following course 1(*b*), comprises loops 18 pulled to face 9 of the fabric only. The loops 18 are arranged in groups of three separated by yarn regions 21 extending course-wise and containing no knitted loops. The yarn regions 21 extend between loops 18 drawn to the same face 9 of the fabric and have a length equal to four needle spaces of the needle bed on which the course 1(*c*) is knitted (equivalent to eight needle spaces taking both needle beds into account). The length of the yarn regions 21 can also be characterised as equal to seven wales which means that each region 21 extends across seven empty needles, taking account of needles of both beds or three empty needles taking account of needles of the bed on which the course 1(*c*) is knitted.

Of course a fabric may be knitted on a half-gauge machine, that is u sing only half the needles of the machine so that references to empty needles in indicating the length of the regions 21 must be taken as references to "empty, active" needles, that is to needles empty in course 1(*c*) but used elsewhere in forming the fabric structure. For this reason it is better to characterise the length of such regions by reference to the wales over which the regions extend. The other course-wise regions of yarn 22 in the course 1(*c*) each extend between loops 18 over one wale.

Course 1(*d*) which follows course 1(*c*) has exactly the same configuration as course 1(*c*) and is followed by a course sequence exactly like courses 1(*a*) to 1(*c*) and so on. That is, the fabric pattern is a four course repeat and by choosing appropriate colours of yarn for the four courses, a striped pattern is produced.

In the following description relating to the fabrics shown in the various figures of the drawings, the properties of the fabrics are given in respect of fabrics knitted in the constructions shown and described using a 715 decitex air-textured yarn of continuous polyester filaments. The fabrics were all knitted on a Dubied Jet 2F flat V-bed knitting machine equipped with 12 gauge latch needles.

In the example of FIG. 1, the fabric was knitted on both needle beds of the knitting machine which had a total of 600 needles. In courses 1(*a*) and 1(*b*), 450 of the needles were active (i.e. yarn was taken into the needle hooks) in knitting those courses and the length of yarn supplied to the courses was 229.5 cm and 230.9 cm respectively. In courses 1(*c*) and 1(*d*), 150 of the needles were active in knitting those courses and the length of yarn supplied to the courses was 98.0 cm and 97.6 cm respectively. The width of the fabric produced on a total of 600 active needles was measured at 54.5 cm after the fabric had been removed from the knitting machine and given a steam relaxation.

For the above fabric, figures for the length of yarn per active needles and the length of yarn per total needles for each course are shown in the following Table 1:

TABLE 1

| Course | Length of Yarn Supplied (cm) | Length of Yarn (cm) per Active Needles | Length of Yarn (cm) per Total Needles |
|---|---|---|---|
| 1(a) | 229.5 | 0.51 | 0.38 |

TABLE 1-continued

| Course | Length of Yarn Supplied (cm) | Length of Yarn (cm) per Active Needles | Length of Yarn (cm) per Total Needles |
|---|---|---|---|
| 1(b) | 230.9 | 0.51 | 0.38 |
| 1(c) | 98 | 0.65 | 0.16 |
| 1(d) | 97.6 | 0.65 | 0.16 |

Figure 2B:
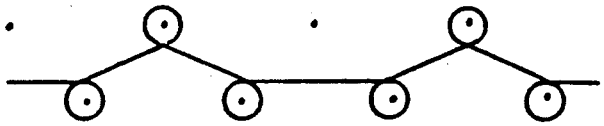
Figure 2C:
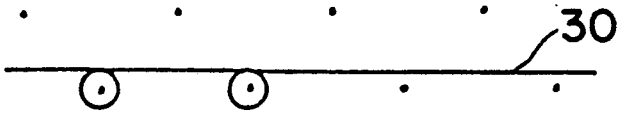
Figure 2D:
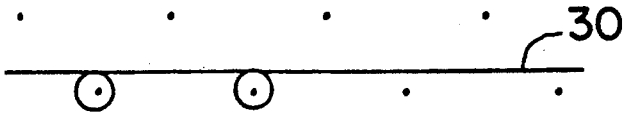
Figure 2E:
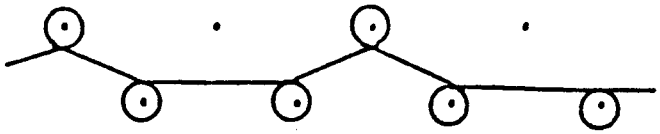
Figure 2F:
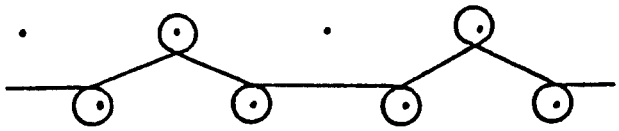
Figure 2G:
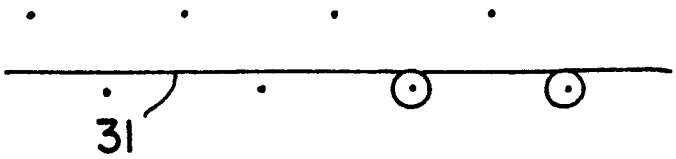
Figure 2H:
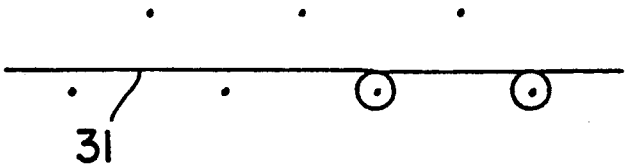

The fabric of FIG. 2 has a structure similar to that of FIG. 1 but in this case an eight course repeat (a)–(h) is used and the wale location of the knitted loops in the single bed courses (c), (d) and (g), (h), is different in each four course section of the repeat. FIG. 2, courses (a) to (h), are hereinafter designated courses 2(*a*) to 2(*h*). Thus, the yarn regions 30 of the courses 2(*c*) and 2(*d*) in which yarn not containing knitted loops extend course-wise between loops of the respective course are situated in different wale locations from similar yarn regions 31 of the courses 2(*g*) and 2(*h*). Each of the yarn regions 30 and 31 extends over five wales, that is over five needles which at other stages in the formation of the fabric take yarn and form loops to contribute to the production of a knitted wale in the fabric.

If the structure shown in FIG. 2 is repeated, then the relatively inextensible yarn regions 30 and 31 alternate between a second set of wales and a first set of wales at four course intervals. This alternating between wales further improves the rigidity of the fabric. If appropriate colours of yarn are chosen for the eight courses, a checked pattern is produced.

FIG. 3 containing courses (a) to (d), designated courses 3(*a*) to 3(*d*) respectively, illustrates the three course repeat of a "Milano Rib" fabric (which is outside the scope of the invention) in which successive courses 3(*a*) and 3(*b*) each have loops pulled to a single face of the fabric but to a different face respectively. Course 3(*c*) is a 1×1 rib structure.

A piece of fabric with a width of 49.2 cm after steaming was produced on 600 needles in this structure. In courses 3(*a*) and 3(*b*), 300 of the needles were active in knitting and the length of the yarn supplied to the courses was 124.3 cm and 120.9 cm respectively. In course 3(*c*) 600 of the needles were active and the length of yarn supplied to the course was 289.6 cm.

For the above fabric, figures for the length of yarn per active needles and the length of yarn per total needles for each course are shown in the following Table 2:

TABLE 2

| Course | Length of Yarn Supplied (cm) | Length of Yarn (cm) per Active Needles | Length of Yarn (cm) per Total Needles |
|---|---|---|---|
| 3(a) | 124.3 | 0.41 | 0.21 |
| 3(b) | 120.9 | 0.40 | 0.20 |
| 3(c) | 289.6 | 0.48 | 0.48 |

The fabrics of FIGS. 1 and 3 were tested for extensibility and recovery after stretching by the following test method:

The extensibility test was carried out on a Fryma dual extensiometer on fabric specimens cut to a size of 90 mm by 75 mm, the longer dimension corresponding to the direction of measurement of the stretch (wale or course). The tests were carried out in accordance with the conditions prescribed in British Standard Specification BS 4294:1968 with the jaw separation of the extensiometer set at 75 mm. One end of the specimen under test was clamped in the fixed jaw, a "Perspex" (Trade Mark) plate was placed on top of the specimen to ensure it was flat and the other end of the specimen was then clamped in the movable jaw. The "Perspex" (Trade Mark) plate was removed and the specimen was then loaded and measured as specified in BS 4294:1968. The measurements were carried out at 20° C. and 65.0 Relative Humidity.

Extensibility is expressed as percentage extensibility, that is the percentage of the original length of the fabric sample before stretching by which the fabric is extended in the test.

The ability of the fabric to recover after being stretched was assessed by measuring the amount by which the fabric sample remained extended beyond its original length in the direction in which it had been stretched after the load had been removed. This was assessed 1 minute and 30 minutes after removal of the stretching load and expressed as a percentage extension based on the original length of the sample.

The results of the extensibility and recovery from stretch tests on the fabrics of FIGS. 1 and 3 are shown in the following Table 3:

TABLE 3

| Fabric | Direction | Extensibility % | % Extension after 1 minute | % Extension after 30 minutes |
|---|---|---|---|---|
| FIG. 1 | wale | 7.8 | 0 | 0 |
| | course | 9.6 | 0 | 0 |
| FIG. 3 | wale | 12.0 | 0 | 0 |
| | course | 25.3 | 1.3 | 1.3 |

The Milano Rib fabric of FIG. 3 is not made by a process according to the invention and its high extensibility of 25.3% in the course direction does not meet the desired standard for vehicle seat upholstery fabric of 12% or less extensibility. In contrast, the fabric of FIG. 1 has an extensibility in both wale and course directions of less than 10%.

A fabric having the structure of FIG. 1 was knitted over the same number of needles with a shorter average length of yarn supplied to courses 1(*a*) and 1(*b*) of 222.5 cm and to courses 1(*c*) and 1(*d*) of 96.8 cm. For this fabric, figures for the length of yarn per active needles and the length of yarn per total needles for each course are shown in the following Table 4:

TABLE 4

| Course | Length of Yarn Supplied (cm) | Length of Yarn (cm) per Active Needles | Length of Yarn (cm) per Total Needles |
|---|---|---|---|
| 1(a) | 219.8 | 0.49 | 0.37 |
| 1(b) | 226.1 | 0.50 | 0.38 |
| 1(c) | 99.4 | 0.66 | 0.17 |
| 1(d) | 94.2 | 0.63 | 0.17 |

The fabric of FIG. 1 modified as specified in Table 4 above was tested for stretch and stretch recovery according to the test described earlier and the results are shown in Table 5 as follows:

TABLE 5

| Fabric | Direction | Stretch % | % Extension after 1 minute | % Extension after 30 minutes |
|---|---|---|---|---|
| FIG. 1 | wale | 7.8 | 0 | 0 |

TABLE 5-continued

| Fabric | Direction | Stretch % | % Extension after 1 minute | % Extension after 30 minutes |
|---|---|---|---|---|
| | course | 7.8 | 0 | 0 |

Thus it can be seen that if the fabric of FIG. 1 is knitted sufficiently tightly, it can be made sufficiently rigid to have a stretch of less that 8% in both wale and course directions.

The fabrics described above were produced on a flat V-bed knitting machine having a gauge of 12, that is 12 needles to the inch (2.54 cm). This gauge is sometimes designated E12. As mentioned, the yarn used was a 715 decitex air-textured yarn of continuous polyester filaments. In general, the fabrics according to the invention were knitted very tightly with as short a stitch length as possible in a commercial knitting operation, taking into account the nature of the yarn and its count and the gauge of the machine. If a finer gauge machine is used to knit fabric according to the invention, a shorter stitch length and thus a shorter length of yarn per active needles would be appropriate to achieve fabric according to the invention. Thus, the figures in relation to the length of yarn supplied in each course given in relation to the fabrics of FIGS. 1 and 2 are representative of fabrics according to the invention knitted on a 12 gauge machine. In knitting fabrics according to the invention on machines of other gauges, the length of yarn supplied to each course is adjusted according to the machine gauge to give the equivalent tight stitch structure and therefore the required stretch in the fabric of 12% or less.

As a guide to the tightness of knitting in fabrics according to the invention knitted on machines of different gauges, the general rule is that the yarn supplied per length of needle bed should remain approximately the same for a given structure knitted on different gauges if equivalent stretch properties are to be achieved and thus the length of yarn supplied per total needles will decrease as the gauge becomes finer.

The fabrics described above are knitted on a twin bed, 12 gauge V-flat knitting machine having 300 needles on each bed and a bed length over which knitting takes place of 63.5 cm. Expressed in relationship to bed length, the length of yarn supplied to the courses of the fabric of FIG. 1 are shown in the following Table 6:

TABLE 6

| Courses | Length of Yarn Supplied (cm) | Length of Yarn Supplied per Bed Length (cm/cm) |
|---|---|---|
| 1(a) | 229.5 | 3.61 |
| 1(b) | 230.9 | 3.63 |
| 1(c) | 98.0 | 1.54 |
| 1(d) | 97.6 | 1.54 |

For the fabric made according to the structure of FIG. 1 but with the reduced lengths of yarn supplied to each course as set out in Table 4, the corresponding figures expressed in relationship to bed length are shown in Table 7:

TABLE 7

| Courses | Length of Yarn Supplied (cm) | Length of Yarn Supplied per Bed Length (cm/cm) |
|---|---|---|
| 1(a) | 219.8 | 3.46 |
| 1(b) | 226.1 | 3.56 |
| 1(c) | 99.4 | 1.57 |

TABLE 7-continued

| Courses | Length of Yarn Supplied (cm) | Length of Yarn Supplied per Bed Length (cm/cm) |
|---|---|---|
| 1(d) | 94.2 | 1.48 |

For the fabric outside the invention shown in FIG. 3, the corresponding figures expressed in relationship to bed length are shown in Table 8:

TABLE 8

| Courses | Length of Yarn Supplied (cm) | Length of Yarn Supplied per Bed Length (cm/cm) |
|---|---|---|
| 3(a) | 124.3 | 1.96 |
| 3(b) | 120.9 | 1.90 |
| 3(c) | 289.6 | 4.56 |

What is claimed is:

1. A weft knitted double jersey fabric suitable for use as an upholstery fabric of which at least a substantial part of the fabric has a repeating structure of a group of at least three courses including at least one course having loops pulled to both faces of the fabric, at least one course having all, or substantially all, loops pulled to one face of the fabric, and yarn regions extending course-wise without loops, and wales transverse to said group of courses comprising repeating sets of wales in which a first set of two or more wales is adjacent to a second set of two or more wales, adjacent wales in the first set having loops on opposite faces of the fabric with the loops on one face being in number ratio to the loops on the other face of at least 3:1 and the second set of wales being traversed in at least one of the courses having all, or substantially all, of the loops pulled to one face of the fabric by a yarn region without loops which extends between loops across two or more wales, said structure and the tightness of the knitting being such that the stretch of the fabric is no more than 12% in wale and course directions respectively.

2. A weft knitted fabric as claimed in claim 1 wherein a group of courses comprises at least four courses.

3. A weft knitted fabric as claimed in claim 2 wherein a group of courses has at least two courses having a yarn region without loops extending between loops across two or more wales in said second set of wales.

4. A weft knitted fabric as claimed in claim 2 wherein for a group of courses the number of courses having loops pulled to both faces of the fabric is equal to the number of courses having all, or substantially all, loops pulled to one face of the fabric.

5. A weft knitted fabric as claimed in claim 2 where for the first set of wales the said number ratio of loops is at least 4:1.

6. A weft knitted fabric as claimed in claim 1 wherein two successive groups of courses have as specified, a first set of wales in the first group of courses aligned with a second set of wales in the second group of courses and a second set of wales in the first group of courses aligned with a first set of wales in the second group of courses.

7. A weft knitted fabric as claimed in claim 1 wherein in addition to a yarn region without loops extending between loops across two or more wales in at least one of the courses having all, or substantially all, of the loops pulled to one face of the fabric, there are additional yarn regions extending course-wise without loops across at least one wale in at least one other course in said group of courses.

8. A weft knitted fabric as claimed in claim 7 wherein said additional yarn regions are located in two or more courses having loops pulled to both faces of the fabric with said additional yarn regions in one such course extending across wales different from the wales across which said additional yarn regions extend in another such course.

9. A weft knitted fabric as claimed in claim 1 wherein for the second set of wales, the yarn region without loops extends between loops across at least three wales.

10. A weft knitted fabric as claimed in claim 1 wherein for the second set of wales, the yarn region without loops extends between loops across at least seven wales.

11. A weft knitted fabric as claimed in claim 1 wherein for all, or substantially all, of those courses having all, or substantially all, of the loops pulled to one face of the fabric and having incorporated said yarn regions extending between loops across at least two wales, it is the same face of the fabric to which said loops are pulled.

12. A weft knitted fabric as claimed in claim 1 wherein for at least some courses having loops pulled to both faces of the fabric, the length of yarn supplied per length of needle bed over which the fabric is knitted is no more than 4.0 cm/cm and in at least some courses having all, or substantially all, of the loops pulled to one face of the fabric, the length of yarn supplied per length of needle bed over which the fabric is knitted is not more than 2.0 cm/cm.

13. A weft knitted fabric as claimed in claim 1 wherein for at least some courses having loops pulled to both faces of the fabric, the length of yarn supplied per active needles is less than 0.40 cm and in at least some courses having all, or substantially all, of the loops pulled to one face of the fabric, the length of yarn supplied per active needles is less than 0.20 cm.

14. A weft knitted fabric as claimed in claim 1 wherein the stretch of the fabric is no more than 10% in one or both of the wale and course directions.

15. A weft knitted fabric as claimed in claim 1 wherein the stretch of the fabric is no more than 8% in one or both of the wale and course directions.

16. A weft knitted fabric as claimed in claim 1 wherein the yarn comprising the fabric has a count in the unrelaxed state of from 550 to 850 decitex.

17. A weft knitted fabric as claimed in claim 1 wherein the yarn comprising the fabric has a count in the unrelaxed state of from 680 to 750 decitex.

18. A weft knitted fabric as claimed in claim 16 wherein the yarn comprising the fabric is an air-textured, polyester yarn.

19. A weft knitted fabric as claimed in claim 1 wherein the fabric has been knitted on a 12 gauge flat V-bed knitting machine.

20. A weft knitted fabric as claimed in claim 12, wherein in said at least some courses having all, or substantially all, of the loops pulled to one of the faces of the fabric, the length of yarn supplied per length of needle bed over which the fabric is knitted is no more than 1.8 cm/cm.

21. An upholstery cover as claimed in claim 20 wherein the fabric has been shaped in the knitting to produce said cover shaped at least in part to fit the vehicle seat.

22. A weft knitted fabric as claimed in claim 1, wherein the fabric is an upholstery cover for a vehicle seat.

23. A process for weft knitting a double jersey fabric suitable for use as an upholstery fabric comprising feeding yarns to beds of needles on a weft knitting machine and knitting the yarns using said needles to form a weft knitted fabric wherein at least a substantial part of the fabric is knitted with a repeating structure of a group of at least three courses including at least one course having loops pulled to both faces of the fabric and at least one course having all, or substantially all, loops pulled to one of the faces of the fabric and having yarn regions extending course-wise without loops, and repeating sets of wales transverse to said group of courses having a first set of at least two wales located adjacent to a second set of at least two wales, forming adjacent wales in the first set with loops on said both faces of the fabric with the loops on the one of said faces being in number ratio to the loops on the other face of at least 3:1, and the second set of wales being traversed in at least one of the courses having all, or substantially all, of the loops pulled to one face of the fabric by a yarn region without loops extending between loops across two or more wales, and limiting the yarn feed to the needle beds such that in at least some courses having loops pulled to said both faces of the fabric the length of yarn supplied per length of needle bed over which the fabric is knitted is no more than 4.0 cm/cm and in at least some courses having all, or substantially all, of the loops pulled to one face of the fabric, the length of yarn supplied per length of needle bed over which the fabric is knitted is no more than 2.0 cm/cm.

24. A process for weft knitting according to claim 23 further comprising forming in said first set of wales a number ratio between the loops on the one of said faces of the fabric and the loops on the other of said faces of the fabric of at least 4:1 and forming said at least some courses having all, or substantially all, of the loops pulled to one of said faces of the fabric using a length of yarn supplied per length of needle bed over which the fabric is knitted of no more than 1.8 cm/cm.

* * * * *

UNITED STATES PATENT AND TRADEMARK OFFICE

CERTIFICATE OF CORRECTION

PATENT NO. : 5,209,084

DATED : May 11, 1993

INVENTOR(S) : Frank Robinson and Gerald Day

It is certified that error appears in the above-indentified patent and that said Letters Patent is hereby corrected as shown below:

Col. 9, line 51, (Claim 5) change "where" to --wherein--.

Signed and Sealed this

Twenty-fifth Day of January, 1994

*Attest:*

Bruce Lehman

BRUCE LEHMAN

*Attesting Officer*

*Commissioner of Patents and Trademarks*